United States Patent [19]

Dunham et al.

[11] Patent Number: 4,643,149

[45] Date of Patent: Feb. 17, 1987

[54] ADJUSTABLE THROTTLE LINKAGE FOR OUTBOARD MOTORS

[75] Inventors: William D. Dunham, Waukegan; Gerald L. Miller, Antioch, both of Ill.

[73] Assignee: Outboard Marine Corporation, Waukegan, Ill.

[21] Appl. No.: 752,063

[22] Filed: Jul. 5, 1985

[51] Int. Cl.[4] ..... F02D 9/00

[52] U.S. Cl. ..... 123/403; 440/87; 440/900

[58] Field of Search ..... 123/400–403, 123/413; 440/87, 900; 74/480 R, 480 B, 586

[56] References Cited

U.S. PATENT DOCUMENTS

| | | | |
|---|---|---|---|
| 1,102,782 | 7/1914 | Mills | 74/586 |
| 1,329,645 | 3/1920 | Warrener | 74/586 |
| 1,523,142 | 1/1925 | Sargent | 74/586 |
| 2,103,348 | 12/1937 | Boyce | 123/413 |
| 2,451,636 | 10/1948 | Spiller | 74/586 |
| 2,561,440 | 7/1951 | Garson | 74/480 B |
| 2,600,852 | 6/1952 | Coots | 440/87 |
| 2,653,663 | 9/1953 | Maxant | 74/586 |
| 2,702,615 | 2/1955 | Morse | 440/87 |
| 2,968,192 | 1/1961 | Fletcher | 74/480 |
| 3,078,738 | 2/1963 | Siegel | 74/586 |
| 3,234,924 | 2/1966 | May . | |
| 4,071,002 | 1/1978 | Frahm | 123/413 |
| 4,492,198 | 1/1985 | Okumura | 123/403 |

FOREIGN PATENT DOCUMENTS

| | | | |
|---|---|---|---|
| 611552 | 11/1948 | United Kingdom | 123/403 |

*Primary Examiner*—William A. Cuchlinski, Jr.
*Attorney, Agent, or Firm*—Michael, Best & Friedrich

[57] ABSTRACT

An adjustable throttle linkage for use in an outboard motor having a pivotable throttle valve, and a throttle lever for controlling the position of the throttle valve. The adjustable throttle linkage comprises a connecting link having opposite ends, one end being connected to the throttle lever. The other end of the connecting link is adjustably connected to a control member in turn connected to the throttle valve. The apparatus for adjustably connecting includes a yoke connected to the control member, and the yoke includes a body having a first portion including a central bore adapted to house the threaded portion of the connecting link. The yoke includes a slot including opposed surfaces and housing a thumb wheel, the thumb wheel being threaded onto the threaded portion of the connecting link such that threaded movement of the thumb wheel on the connecting link causes movement of the yoke with respect to the connecting link.

8 Claims, 4 Drawing Figures

ADJUSTABLE THROTTLE LINKAGE FOR OUTBOARD MOTORS

FIELD OF THE INVENTION

The invention relates to internal combustion engines and outboard motors, and more particularly, to throttle linkages and means for adjusting throttle linkages.

BACKGROUND OF THE INVENTION

Attention is directed to the Donohue U.S. patent application Ser. No. 635,172, filed July 27, 1984 now U.S. Pat. No. 4,602,602 and assigned to the assignee of the present application. That patent application illustrates a throttle control linkage for use in an outboard motor, the throttle control linkage including a bolt or link connected to a throttle lever and a connecting member threaded onto the bolt and providing a means for connecting the bolt to a cam. The cam is in turn functional to control the position of a throttle valve of a carburetor. The connecting member includes a central threaded bore such that it can be threaded onto the bolt or link. Adjustment of the relative position of the throttle lever and the cam is achieved by disconnecting the bolt or link from the throttle lever and then rotating the link in the threaded bore of the connecting member. The link is then reattached to the throttle lever.

Attention is also directed to the Frahm U.S. Pat. No. 4,071,002, issued Jan. 31, 1978; the May U.S. Pat. No. 3,234,924, issued Feb. 15, 1966; the Fletcher U.S. Pat. No. 2,968,192, issued Jan. 17, 1961; the Morse U.S. Pat. No. 2,702,615 issued Feb. 22, 1955; and the Boyce U.S. Pat. No. 2,103,348, issued Dec. 28, 1937.

Attention is further directed to the Maxant U.S. Pat. No. 2,653,663, issued Sept. 29, 1953; the Coots U.S. Pat. No. 2,600,852, issued June 17, 1952; the Garson U.S. Pat. No. 2,561,440, issued July 24, 1951 and the Spiller U.S. Pat. No. 2,451,636, issued Oct. 19, 1948. Attention is further directed to the Sargent U.S. Pat. No. 1,523,142; the Warrener U.S. Pat. No. 1,329,645, issued Feb. 3, 1920; the Mills U.S. Pat. No. 1,102,782, issued July 7, 1914; the Connelly U.S. Pat. No. 842,770, issued Jan. 29, 1907 and the Siegel U.S. Pat. No. 3,078,738, issued Feb. 26, 1963.

SUMMARY OF THE INVENTION

The invention comprises an adjustable throttle linkage for use in controlling operation of an internal combustion engine having a carburetor including a pivotable throttle valve, a throttle valve position control member operably connected to the throttle valve and movable so as to control the position of the throttle valve, and a throttle control lever for controlling the position of the throttle valve. The adjustable throttle linkage includes a connecting link having opposite ends, one of the opposite ends being connected to one of the throttle control lever and the throttle valve position control member. Means are further provided for adjustably connecting the other of the opposite ends of the connecting link to the other of the throttle control lever and the throttle valve position control member, the means for adjustably connecting including means for adjusting the position of the throttle lever with respect to the throttle valve position control member while the throttle lever and the throttle valve position control member are joined by the connecting link.

The invention also includes an outboard motor having a throttle valve supported for pivotal movement between a throttle open position and a throttle closed position, means for controlling the position of the throttle valve including a movable member connected to the throttle valve for causing movement of the throttle valve, a throttle lever supported for pivotal movement, and means for connecting the throttle lever to the movable member. The means for connecting includes a connecting link having opposite ends, one of the opposite ends being connected to one of the throttle lever and the movable member, and a second portion of the connecting link being threaded. Means are also provided for adjustably connecting the second portion of the connecting link to the other of the movable member and the throttle lever, the means for adjustably connecting including adjustment means for adjusting the position of the throttle lever with respect to the movable member while the throttle lever and the movable member are joined by the connecting link.

In one embodiment of the invention the means for adjustably connecting comprises a yoke connected to the other of the throttle valve position control member and the throttle lever, the yoke including a body having a first portion including a central bore adapted to house the threaded portion of the connecting link. The first portion of the yoke includes a slot including opposed surfaces. An adjustment member is housed in the slot and has a central threaded bore. The adjustment member is threaded onto the threaded portion of the connecting link, and the adjustment member has opposed faces, one of the faces engageable with one of the opposed surfaces of the slot and the other of the faces of the adjustment member is engageable with the other of the opposed surfaces of the slot such that threaded movement of the adjustment member on the connecting link causes movement of the yoke with respect to the connecting link.

Various other features and advantages of the invention will be apparent from the following description of a preferred embodiment, from the claims and from the drawings.

Figure 2:
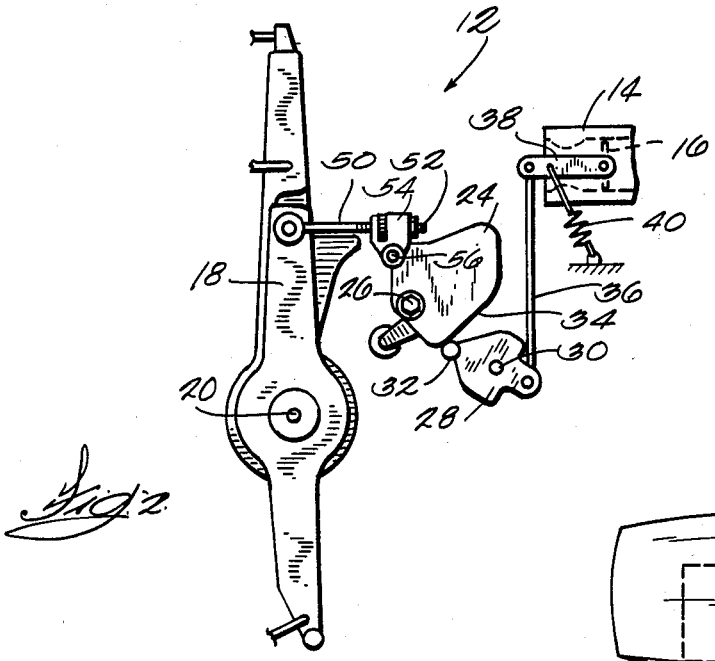
FIG. 2 is an enlarged view of a portion of the outboard motor illustrated in FIG. 1.

Before describing at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Figure 1:
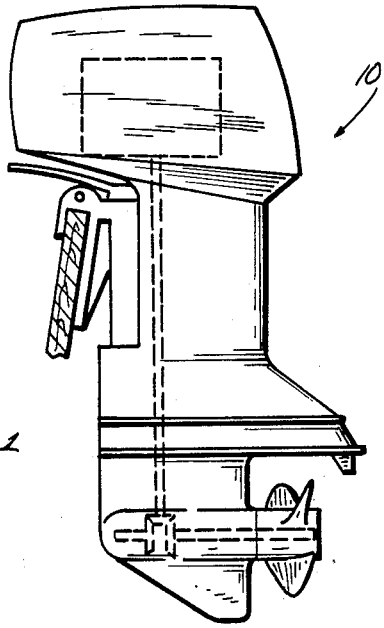
FIG. 1 is a side elevation view of an outboard motor embodying the invention.
Figure 3:
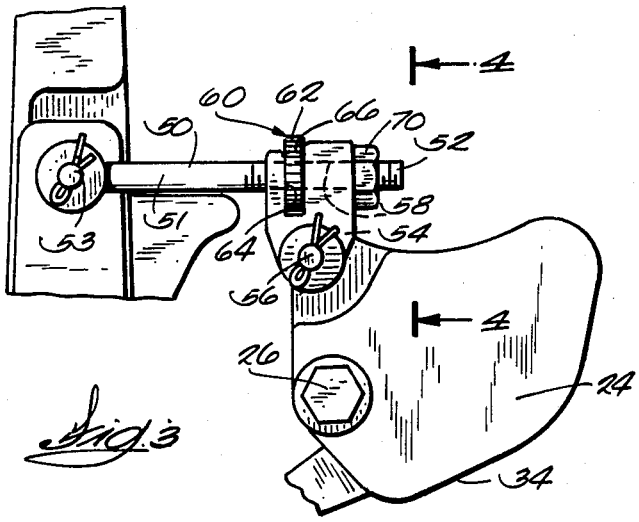
FIG. 3 is an enlarged view of a throttle connecting assembly illustrated in FIG. 2.
Figure 4:
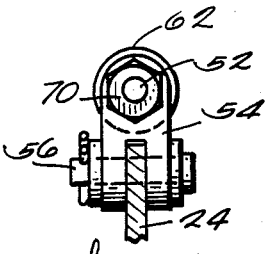
FIG. 4 is a cross section view taken along line 4—4 in FIG. 3.

Illustrated in FIG. 1 is an outboard motor 10 including an internal combustion engine 12. The engine 12 includes a carburetor having a throat 14 housing a pivotable throttle valve 16 for controlling the flow of the fuel mixture through the carburetor throat 14. The engine 12 also includes a throttle arm or lever 18 supported for pivotal movement about a central pivot 20.

Means are also provided for connecting the throttle lever 18 to the throttle valve 16 such that pivotal movement of the throttle lever 18 about the central pivot 20 will cause consequent pivotal movement of the throttle valve 16 about its central pivot axis and to thereby control the position of the throttle valve 16. While various means could be provided for connecting the throttle lever 18 to the throttle valve 16, in the illustrated arrangement, the apparatus includes a cam 24 supported for pivotal movement about a pivot shaft 26 and connected to the throttle lever 18. The cam 24 is caused to pivot about the pivot shaft 26 in response to movement of the throttle lever 18. A second cam 28 is supported for pivotal movement about a parallel pivot shaft 30 and the second cam 28 includes a roller 32 adapted to engage a cam surface 34 of the first cam 16. A linkage 36 is pivotally connected at one of its ends to the second cam 28 and is pivotally connected at an opposite end to a lever 38 supporting the throttle valve 16.

In a preferred form of the invention, a spring 40 is connected to the lever 38 and biases the lever 38 and throttle valve 16 toward the fuel flow restricting position shown in FIG. 1. When the throttle lever 18 is pivoted in a clockwise direction as shown in FIG. 1, the first cam 24 will be caused to pivot in a clockwise direction around the pivot shaft 26. The cam surface 34 engaging the roller 32 will then cause counter-clockwise rotation of the cam 28, and the linkage 36 connected to the cam 28 will cause pivotal movement of the throttle valve 16 to a throttle open position.

Means are also provided for connecting the throttle lever 18 to the first cam 24 such that the relative position of the throttle lever 18 and first cam 24 can be adjusted with respect to one another and without disconnection of the throttle lever 18 from the cam 24. The means for adjustably connecting the throttle lever 18 to the cam 24 includes a connecting link 50 having one end 51 pivotally connected by a pivot pin 53 to the throttle lever 18. The opposite end of the connecting link comprises a threaded shaft 52. Means are also provided for pivotally connecting the threaded end 52 of the link 50 to the cam 24. This means includes a yoke 54 pivotally connected to the cam 24 by a pin 56, the pin 56 being spaced from the pivot pin 26 supporting the cam 24. The yoke 54 also includes a bore 58 extending perpendicularly to the longitudinal axis of the pin 56 and being adapted to house the threaded shaft portion 52 of the link 50. The bore 58 is larger in diameter than the threaded shaft portion 52 of the link 50 such that the threaded shaft portion 52 of the link 50 is slideably movable in the bore 58 in the direction of the longitudinal axis of the bore. The yoke 54 also includes a slot or space 60 adapted to house a thumb wheel 62 threadably supported on the threaded shaft portion 52 of the link 50. The thumb wheel 62 includes a central threaded bore housing the threaded shaft 52 such that rotation of the thumb wheel 62 on the shaft 52 causes adjustable movement of the thumb wheel along the length of the shaft 50. The thumb wheel 62 also includes opposed faces 64 and is housed between opposed faces 66 of the slot. As the thumb wheel 62 is rotated on the threaded shaft 52, the face 64 of the thumb wheel 62 will engage the opposed face 66 of the slot. Similarly, the other face of the thumb wheel will engage an opposed face of the slot. Stated alternatively, the yoke includes a pair of spaced apart members housing the thumb wheel therebetween in confined relation and such that movement of the thumb wheel 62 along the threaded shaft will cause the thumb wheel to engage one or the other of the members to cause movement of the yoke.

Such rotation of the thumb wheel 62 will cause movement of the yoke 54 along the length of the threaded shaft portion of the link 50, and adjustment of the relative position of the cam 24 with respect to the throttle lever 18 and consequent adjustment of the position of the throttle valve 16 with respect to the throttle lever 18.

In a preferred form of the invention, means are also provided for selectively locking the yoke 54 in place on the link 50 i.e., for limiting movement of the link 50 relative to the yoke 54. While other means could be provided, in the illustrated construction, the means for locking can include a jam nut 70 threaded onto the end of the threaded shaft portion 52 of the link 50 and engaging the yoke 54.

Using the apparatus of the invention, adjustment of the position of the throttle lever with respect to the position of the throttle valve can be accomplished without disconnection of the parts providing connection of the throttle lever and throttle valve. This eliminates the possibility of loss of parts during the adjustment process and also permits adjustment of the throttle valve position with a substantial savings of time. Additionally, by providing for adjustment with the unit when it is assembled, guesswork involved in adjusting the position of the throttle valve is minimized. Furthermore, the thumb wheel can be rotated only a portion of a revolution and thus the relative position of the throttle valve and throttle lever can be accurately controlled.

Various features of the invention are set forth in the following claims.

I claim:

1. An adjustable throttle linkage for use in controlling operation of an internal combustion engine having a carburetor including a pivotable throttle valve, a throttle valve position control member operably connected to the throttle valve and movable so as to control the position of the throttle valve, and a throttle lever for controlling the position of the throttle valve, the adjustable throttle linkage comprising a connecting link having one end connected to one of said throttle lever and said control member, and having a threaded portion, means for adjustably connecting said threaded portion to the other of said throttle lever and said control member, said adjustable connecting means including a slot in the other of said throttle lever and said control member, and a rotatable member threaded onto said threaded portion and receive in said slot such that rotation of said rotatable member causes relative movement between said link and said other of said throttle lever and said control member.

2. An adjustable throttle linkage for use in controlling operation of an internal combustion engine having a carburetor including a pivotable throttle valve, a throttle valve position control member operably connected to the throttle valve and movable so as to control the position of the throttle valve, and a throttle lever for controlling the position of the throttle valve, said adjustable throttle linkage comprising a connecting link having an end connected to one of said throttle lever and said throttle valve portion control member and a threaded portion, and means for adjustably connecting said threaded portion to the other of said throttle lever and said throttle valve position control member, said adjustably connecting means including a yoke connected to said other of said throttle valve position control member and said throttle lever and comprising a first portion including a central bore receiving said threaded portion and also including a lot having opposed surfaces, and an adjustment member located in said slot and having a central threaded bore threaded onto said threaded portion of said connecting link, said adjustment member also having opposed faces, one of said faces being engageable with one of said opposed surfaces of said slot and the other of said faces being engageable with the other of said opposed surfaces of said slot such that rotatable movement of said adjustment member on said connecting link causes movement of said yoke with respect to said connecting link.

3. An adjustable throttle linkage for use in an outboard motor having a carburetor including a throat and a pivotable throttle valve positioned in the throat, a throttle valve position control member operably connected to the throttle valve and moveable so as to control the position of the throttle valve in the throat, and a throttle lever for controlling the position of the throttle valve, said adjustable throttle linkage comprising a connecting link having opposite ends, one of said ends being connected to one of said throttle lever and said throttle valve position control member, and means for adjustably connecting the other of said opposite ends of said connecting link to the other of said throttle lever and said throttle valve position control member, said adjustable connecting means including a yoke connected to said other of said throttle valve position control member and said throttle lever, said yoke including a body having a first portion including a central bore adapted to house said threaded portion of said connecting link, said central bore having a longitudinal axis, said first portion of said yoke including a slot extending transversely to said longitudinal axis of said central bore, said slot including opposed surfaces, a thumb wheel housed in said slot, said thumb wheel having a central threaded bore and being threaded onto said threaded portion of said connecting link, and said thumb wheel having opposed faces, one of said faces being engageable with one one of said opposed surfaces of said slot and the other of said faces of said thumb wheel being engageable with the other of said opposed surfaces of said slot such that threaded movement of said thumb wheel on said connecting link causes movement of said yoke with respect to said connecting link.

4. An outboard motor comprising a propulsion unit having a propeller and an internal combustion engine drivingly connected to said propeller, said internal combustion engine including a carburetor having a throat, a throttle valve housed in said throat and supported for pivotal movement between a throttle open position and a throttle closed position, means for controlling the position of said throttle valve including a movable member connected to said throttle valve for causing movement of said throttle valve, a throttle lever supported for pivotal movement, and means for connecting said throttle lever to said movable member, said connecting means including a connecting link having an end connected to one of said throttle lever and said movable member, and also having a threaded portion, and means for adjustably connecting said threaded portion to the other of said movable member and said throttle lever, said adjustable connecting means including a slot in the other of said movable member and said throttle lever, and a rotatable member threaded onto said threaded portion and received in said slot such that rotatable movement of said rotatable member causes relative movement between said connecting link and said other of said movable member and said throttle lever.

5. An outboard motor comprising a propulsion unit having a propeller and an internal combustion engine drivingly connected to said propeller, said internal combustion engine including a carburetor having a throat, a throttle valve housed in said throat and supported for pivotal movement between a throttle open position and a throttle closed position, means for controlling the position of said throttle valve including a movable member connected to said throttle valve for causing movement of said throttle valve, a throttle lever supported for pivotal movement, and means for connecting said throttle lever to said movable member, said connecting means including a connecting link having an end connected to one of said throttle lever and said movable member, and having a threaded portion, and means for adjustably connecting said threaded portion of said connecting link to the other of said movable member and said throttle lever, said adjustable connecting means including a yoke connected to said other of said movable member and said throttle lever and including a pair of spaced portions having respective aligned bores receiving said threaded portion such that said yoke is slideably movable with respect to said connecting link, and an adjustment member including a central threaded bore which is threaded onto said threaded portion of said connecting link and which is positioned between said pair of spaced portions of said yoke, said adjustment member including opposite faces transverse to said bore, one of said faces being adapted to engage one of said spaced portions and the other of said faces being adapted to engage the other of said spaced portions.

6. An outboard motor as set forth in claim 5 and further including means for limiting movement of said yoke relative to said threaded portion of said connecting link and including a nut threaded onto said threaded portion and adapted to engage said yoke.

7. An outboard motor comprising a propulsion unit having a propeller and an internal combustion engine drivingly connected to said propeller, said internal combustion engine including a carburetor having a throat, a throttle valve housed in said throat and supported for pivotal movement between a throttle open position and a throttle closed position, means for controlling the position of said throttle valve including a movable member connected to said throttle valve for causing movement of said throttle valve, a throttle lever supported for pivotal movement, and means for connecting said throttle lever to said movable member, said connecting means including a connecting link having an end connected to one of said movable member and said throttle lever, said connecting link also having a threaded portion, and means for adjustably connecting said threaded portion of said connecting link to the other of said movable member and said throttle lever, said adjustable connecting means including a yoke connected to said other of said movable member and said throttle lever, and said yoke including a pair of spaced portions, said spaced portions including a bore receiving said threaded portion of said connecting link such that said yoke is slideably movable with respect to said connecting link, and an adjustment member including a central threaded bore threaded onto said threaded portion of said connecting link and being positioned between said pair of spaced portions of said yoke, said adjustment member including opposite faces transverse to the longitudinal axis of said bore, one of said faces being adapted to engage one of said spaced portions and the other of said faces being adapted to engage the other of said spaced portions.

8. A outboard motor as set forth in claim 7 and further including means for limiting movement of said yoke relative to said threaded portion of said linkage and including a nut threaded onto said threaded portion and adapted to engage said yoke.

* * * * *